US006679087B2

(12) United States Patent
Suggs et al.

(10) Patent No.: US 6,679,087 B2
(45) Date of Patent: Jan. 20, 2004

(54) SAFE LOCK MECHANISM

(75) Inventors: Donald K. Suggs, Boise, ID (US); Brian M. Reid, Nampa, ID (US)

(73) Assignee: Rhino Metals, Inc., Caldwell, ID (US)

( * ) Notice: Subject to any disclaimer, the term of this patent is extended or adjusted under 35 U.S.C. 154(b) by 0 days.

(21) Appl. No.: 10/054,636

(22) Filed: Oct. 29, 2001

(65) Prior Publication Data

US 2003/0079663 A1 May 1, 2003

(51) Int. Cl.[7] ..... E05G 1/04

(52) U.S. Cl. ..... 70/153; 70/329; 70/333 R; 70/417; 70/DIG. 63; 109/59 R; 292/158; 292/159

(58) Field of Search ..... 70/153, DIG. 6, 70/DIG. 63, 329, 333 R, 416, 1.5, 1.7, 417; 109/59 R, 59 T; 292/158, 159, 169

(56) References Cited

U.S. PATENT DOCUMENTS

| | | | | | |
|---|---|---|---|---|---|
| 120,915 | A | * | 11/1871 | Vinton et al. | |
| 124,540 | A | * | 3/1872 | Bussey | |
| 393,883 | A | | 12/1888 | Brown, Jr. | |
| 457,872 | A | | 8/1891 | Simon | |
| 480,236 | A | * | 8/1892 | Garland | |
| 491,285 | A | * | 2/1893 | Herrmann | |
| 526,456 | A | | 9/1894 | Murdie | |
| 711,325 | A | * | 10/1902 | Lowrie | |
| 905,623 | A | * | 12/1908 | Allen | |
| 908,813 | A | | 1/1909 | Stevens | |
| 966,195 | A | | 8/1910 | Golden | |
| 1,134,175 | A | | 4/1915 | Wheary | |
| 1,643,538 | A | | 9/1927 | Bell | |
| 1,752,559 | A | * | 4/1930 | Hurd | |
| 1,813,441 | A | | 7/1931 | Diesel | |
| 2,119,456 | A | * | 5/1938 | Dies | |
| 2,379,810 | A | * | 7/1945 | Ledin et al. | |
| 2,468,251 | A | | 4/1949 | Wiederman | |
| 2,537,736 | A | | 1/1951 | Carlson | |
| 2,801,869 | A | | 8/1957 | George | |
| 2,823,536 | A | | 2/1958 | Watson | |
| 3,464,472 | A | | 9/1969 | Reynolds | |
| 3,621,686 | A | * | 11/1971 | Klein | |
| 3,642,313 | A | | 2/1972 | Anderson | 292/66 |
| 4,095,827 | A | | 6/1978 | Stavenau | 292/65 |
| 4,288,944 | A | | 9/1981 | Donovan | 49/395 |
| 4,342,207 | A | | 8/1982 | Holmes et al. | 79/119 |
| 4,368,905 | A | | 1/1983 | Hirschbein | 292/5 |
| 4,470,277 | A | | 9/1984 | Uyeda | 70/118 |
| 4,520,736 | A | * | 6/1985 | Crosby et al. | 109/60 |
| 4,593,545 | A | | 6/1986 | Terry et al. | 70/269 |
| 4,679,415 | A | | 7/1987 | Spratt | 70/118 |
| 5,231,935 | A | * | 8/1993 | Oder et al. | 109/59 R |
| 5,339,662 | A | | 8/1994 | Goldman | 70/278 |
| 5,341,752 | A | * | 8/1994 | Hambleton | 109/59 R |
| 5,603,234 | A | | 2/1997 | Lozier et al. | 70/119 |
| 5,697,234 | A | | 12/1997 | Lozier et al. | 70/119 |
| 5,709,111 | A | | 1/1998 | Henao | 70/104 |
| 5,778,708 | A | | 7/1998 | Crosby et al. | 70/118 |
| 5,819,562 | A | | 10/1998 | Christ | 70/107 |
| 5,915,764 | A | | 6/1999 | MacDonald | 292/66 |
| 5,960,655 | A | | 10/1999 | Miller et al. | 70/303 A |
| 6,152,497 | A | | 11/2000 | Vickers et al. | 292/34 |

* cited by examiner

*Primary Examiner*—Lloyd A. Gall
(74) *Attorney, Agent, or Firm*—Robert L. Shaver; Frank J. Dykas; Stephen M. Nipper

(57) ABSTRACT

The invention relates to a safe mechanism for resistance to drilling, by use of a door mounted crankshaft mechanism. The crankshaft includes a shoulder which transfers force to the safe door rather than transmitting it to other lock mechanism components. A crank plate attached to the crankshaft rotates from an open position to a locking position, and by rotation moves a link arm with attached locking pins laterally into engagement with the doorframe. A re-locker device locks both the crank plate and the link arm in place to make entry more difficult.

17 Claims, 6 Drawing Sheets

SAFE LOCK MECHANISM

BACKGROUND OF THE INVENTION

1. Field of the Invention

The present invention generally relates to safe mechanisms, and more particularly relates to safe mechanisms which are resistant to drilling, cutting, and pounding attacks from outside the safe.

2. Background Information

Locking mechanisms for securing safe doors have existed for many years, and there are large varieties of techniques utilized in such locking mechanisms. Many of such locking mechanisms strive to make it hard for a person to break into a safe by hammering or drilling. When a person tries to break into a safe, they may try to attack the lock mechanism in order to open the safe door. Since most locks have a locking mechanism such as a keyed tumbler, a combination lock, a keypad lock, a fingerprint or other biometric recognition lock, or other locking devices exposed on the surface of the lock, these are points of attack. Many locks also have a handle which is turned to release the safe door and open it. The handle and the handle shaft that goes through the safe door are other points of attack for drilling and hammering. The mechanisms behind the handle shaft and the lock mechanisms are also subject to attack by drilling and hammering.

Many safe designs are configured to deter such attacks on the lock, the handle, the handle shaft, and the mechanisms behind both of these attack points. One way to protect the lock mechanisms behind the handle shaft is to provide a secure support strap behind them. Typically, the shaft would extend through the safe door, and be supported and attached to a support strap which is sometimes placed at an angle across the other parts of the lock mechanism, such as extending from a seven o'clock position to a two o'clock position. A disadvantage of this type of support for the shaft is that if the handle or the handle shaft is struck with a heavy blow, the energy of the blow is transmitted through the safe door to the support strap. With sufficient blows, the support strap can give way and this can give rise to the lock mechanism being defeated.

Another way that safes can be attacked is by drilling out the shaft which is attached to the handle. The shaft can easily be cut off flush to the face of the safe door, and then drilled straight through the shaft, basically eliminating the shaft. If the safe mechanism is not designed to defeat this, drilling out the shaft can lead to the defeat of the locking mechanism. Another part of the safe that is subject to attack is the linkage between the shaft and the pins which extend into the doorframe of the safe. One way to sever these linkages is to use a drift drill to cut sideways through such linkages. A safe needs to be designed to make such cutting or drilling of the linkages difficult.

The safe can also be attacked by drilling out the lock mechanism, such as the keyed tumblers or the combination lock and also drilling or pounding on the tongue which extends from the lock mechanism, and which causes the mechanism to be locked. Pounding on the lock tongue to drive it out of engagement should not result in failure of the lock system.

To address the modes of attack on the lock mechanism, it is an object of the invention to provide a safe mechanism which jams in the locked position if the shaft is drilled out. It is the further object of the invention to provide a safe mechanism that jams in the locked position if the tongue of the lock mechanism is driven out of position, damaged, or deformed, or if any parts of the linkages between the crank or shaft and the locking pins are drilled out, or cut off. It is a further object of the invention to provide a shaft which transmits force to the safe door rather than to the mechanism behind the safe door, when pounded. It is a further object of the invention to provide an anti-drill protection for the lock mechanism itself and nearby components. It is a further objective to provide a safe mechanism which meets all the above requirements and is also simpler to manufacture and of a narrow profile, so that the safe door can be relatively thin.

SUMMARY OF THE INVENTION

These and other objects are accomplished by the safe mechanism disclosed herein. The safe mechanism is designed to be used with a safe which typically includes a separately manufactured lock mechanism, a safe door, and a slider with one or more attached locking pins. In many safe configurations, the slider is a linear piece with locking pins attached, which extend into a frame surrounding the safe door, and thus serves to secure the door in place. The safe mechanism includes a link arm which attaches to the slider of the safe door. The link arm has a first end and second end, and a link arm body in which a slot is defined. The link arm is attached at its second end to the slider. Thus movement of the link arm causes movement of the slider, and the locking pins into and out of engagement with the frame of the door.

The safe mechanism of the invention also includes a crank assembly. The crank assembly includes a crankshaft, a crank plate which is attached to the crankshaft, and a crank slider pin attached to the crank plate. The crank plate is mounted adjacent to the link arm, so that the slider pin engages the slot in the link arm. When the crank plate is rotated about the crankshaft, it thus causes lateral movement of the link arm by movement of the crank slider pin in the slot of the link arm. The crank plate is configured for engagement with the lock mechanism. Thus, when the lock is engaged, the crank plate is prevented from rotating. When the lock mechanism is disengaged, the crank plate may rotate around the crankshaft.

In one configuration of the safe mechanism, the slot which is defined in the link arm, has a vertical section and a horizontal section, which join each other at ninety degrees (90°). In this configuration of the safe mechanism, the crankshaft extends through the horizontal section of the slot. The slot in the link arm can be recessed into the link arm, or it can penetrate completely through the body of the link arm. In the configuration in which the slot extends completely through the link arm, the crank slider pin can also extend completely through the slot and the link arm body. The crank slider pin can also extend partially into the slot, if the slot is recessed into the link arm but does not pass all the way through it. The crankshaft penetrates through the safe door and is attached to a handle which is on the exterior side of the safe door. This handle can take a variety of configurations, and can be a wheel with one or more spokes which attaches to the crankshaft, or it can be a lever which extends to one or both sides of the center of the crankshaft, or the handle can be configured as spokes of a wheel, without the wheel itself, or it can be a knob or other configuration which allow a person outside the safe to turn the handle, and the attached crankshaft.

One configuration of the safe mechanism is one in which the crank plate includes a first notch, which is configured for engagement with the tongue of the lock mechanism. When the tongue of the lock mechanism is extended in a locked position, it engages the first notch of the crank plate. When the tongue of the lock mechanism is retracted, in an open position, then the crank plate may rotate freely. The safe may also include a second notch which is positioned to be engageable with a re-locker. The re-locker is a device which is normally kept in a retracted position. When certain triggers are activated, the re-locker is activated and serves as a secondary locking mechanism, or as a back up to the lock mechanism.

One embodiment of the safe mechanism can also include a crankshaft which includes a shoulder which is configured for mounting on the exterior of the safe door. In this way, if pressure from the exterior is applied to the crankshaft, that pressure is transferred to the safe door by means of the shoulder built into the crankshaft. For instance, if a person breaking into the safe pounded on the exterior end of the crankshaft with a hammer, the force from the hammer blows would press the shoulder into the safe door, and would not press the interior end of the crankshaft against interior components. This can be accomplished by a recess around the crankshaft in the safe door, in which the shoulder is completely or partially recessed. This can also be accomplished by use of a backing piece which is mounted around the crankshaft hole and on the inside surface of the safe door. The shoulder would then press against the backing piece, which becomes an extension of the safe door. In this configuration, the crank passage in the backing piece would be sized smaller than the crankshaft shoulder in order to transfer pressure from the shoulder into the safe door. When used with a backing piece, the shoulder can be fully or partially recessed in the crank passage in the safe door.

Another configuration of the safe mechanism is for use with a safe as described above, which includes a re-locker mechanism which acts as secondary lock to the lock mechanism, and which, when activated, extends a re-locking tool for engagement with both the crank plate and the link arm. The purpose of this is to provide a higher level of security so that if the re-locking of the crank plate can be defeated, the link arm will still be locked in place. If the link arm were freed, then the crank arm would still be locked in place. In order to defeat this re-locker mechanism, engagement of the re-locker with both the crank plate and the link arm would have to be defeated. The re-locking tool can be a rectangular bar which is extendable for engagement with the crank plate and the link arm. The re-locker mechanism can operate by the generally rectangular bar engaging a re-locker notch in the crank plate and a re-locker notch in the link arm.

One of the triggers for activation of the re-locker mechanism is a deflection of the lock mechanism from its normal operating position. Another mechanism for triggering the re-locker mechanism is deflection of the lock tongue of the lock mechanism from its normal engaged position. Yet another trigger means for activation of the re-locker mechanism is deflection of the protective cage. Yet another trigger means for activation of the re-locker mechanism is deflection of the back of the lock mechanism.

Another embodiment of the safe mechanism of the invention is one having the features listed below. This embodiment of the safe mechanism includes a link arm whose body includes a first and a second end. The second end is attached to a slider, and when the link arm moves back and forth, the slider also moves back and forth, and pushes linking pins which are attached to the slider into engagement with the doorframe of the safe. This version also includes a crank assembly which includes a crankshaft with a shoulder section built into it, a crank plate with a first and a second notch, and crank slider pin which is attached to the crank plate and extends out from the crank plate. The link arm body includes a notch with a horizontal section and a vertical section which are joined to each other at approximately a ninety-degree (90°) angle. The crank plate is mounted adjacent to the link arm, so that the crank slider pin of the crank plate fits in the slot of the link arm, and the crankshaft also passes through the slot in the link arm. As the crank plate is rotated, the movement of the crank slider pin in the slot of the link arm causes the link arm to move laterally, thus engaging and disengaging the locking pins which are attached to the slider, which itself is attached to the link arm. This version of the safe mechanism also includes a re-locker mechanism, which, when released by an arming plate 78, engages both the crank plate and the link arm, by a generally rectangular re-locker bar engaging a notch in the crank plate and the link arm.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
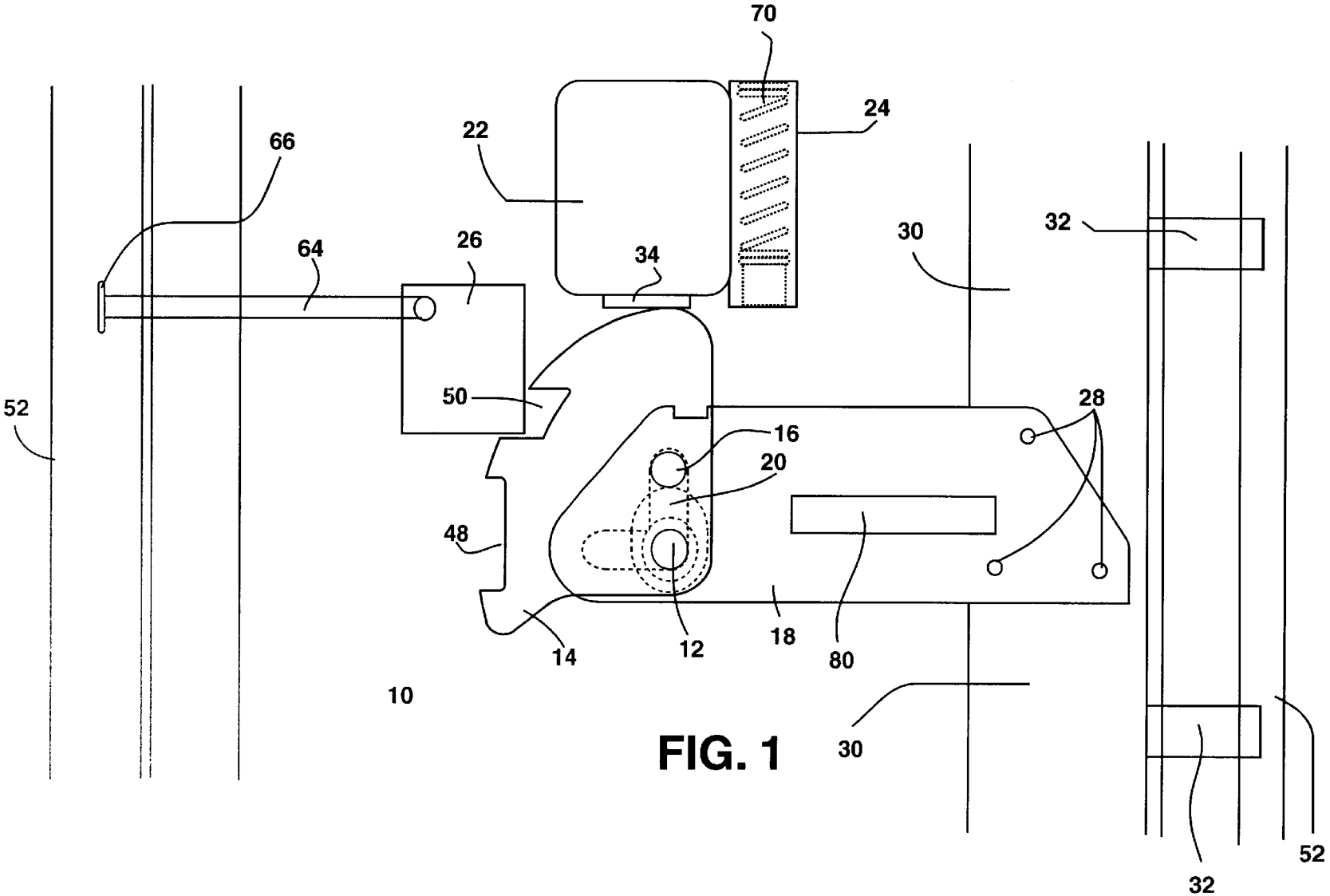
FIG. 1 is an elevational view of the lock mechanism in an open position.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 4:
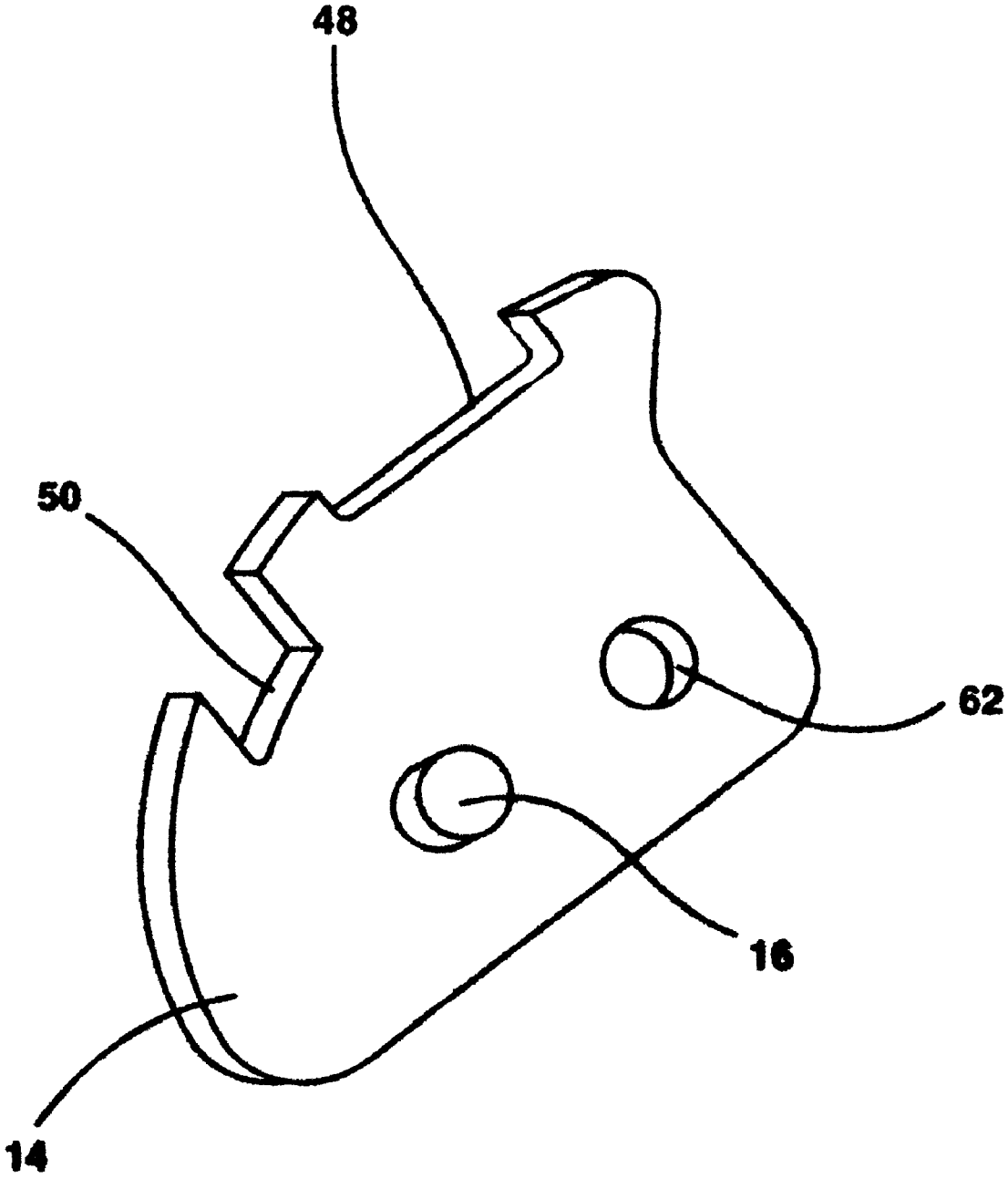
FIG. 4 is a perspective view of the crank plate.
Figure 5:
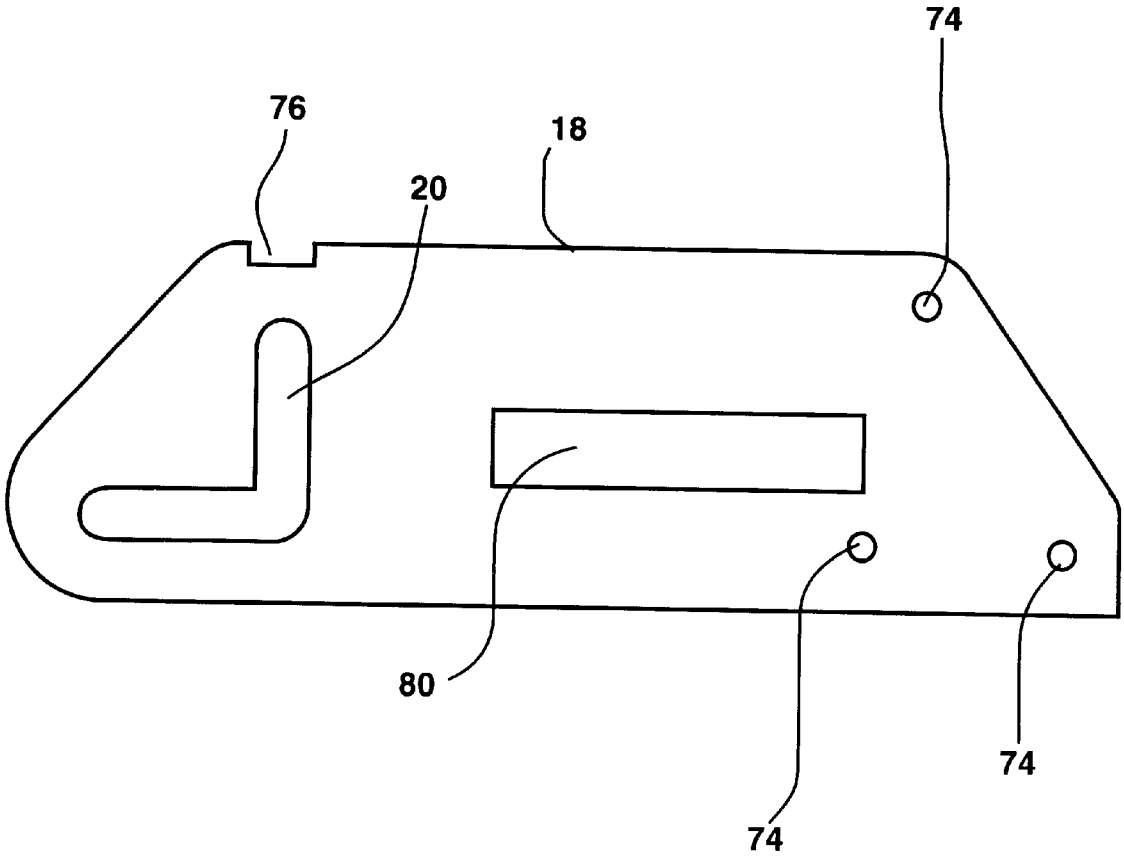
FIG. 5 is an elevational view of the link arm.
Figure 6:
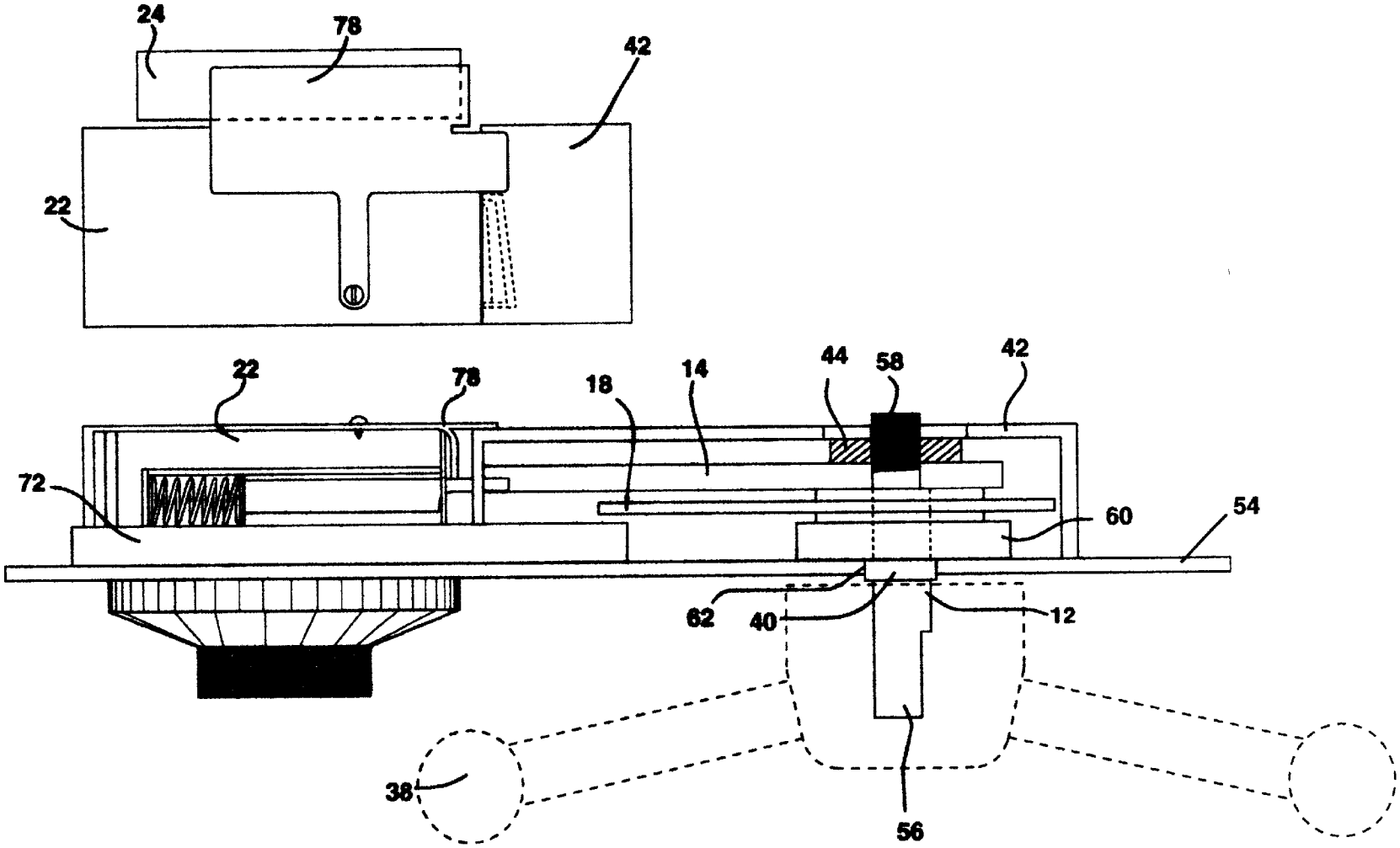
FIG. 6 is a side, cross-sectional view of the safe door and the lock mechanism.

One of the preferred embodiments of the invention is shown in FIGS. 1 through 6. FIG. 1 is an elevational view with a partial cutaway. It shows the safe mechanism 10 and the components parts which include the crank plate 14, the crankshaft 12, the link arm 18, the lock mechanism 22, the re-locker 24, the link arm slot 20, the crank slider pin 16, positioning bolts 28, the open position lock 26, the slider 30, and locking pins 32. In this device, a safe door (not shown in FIG. 1) is secured when a slider 30 is pushed laterally by the link arm 18 so that locking pins 32 engage the doorframe 52, and secure the safe door to the doorframe 52. The link arm 18 is made to slide laterally by rotation of the crankshaft 12 by a handle (shown in FIG. 6), which is attached to the crankshaft 12, exterior to the safe door 54 (shown in FIG. 6). The crankshaft 12 is best shown in FIG. 6. The crankshaft 12 includes a shoulder 40 and a flat-sided first end 56 and a threaded second end 58. The handle 38 is affixed to the flat-sided first end 56 so that turning handle 38 causes crankshaft 12 to turn through the safe door 54. The crankshaft 12 passes through a crankshaft passage 62 in the safe door 54. Attached, preferably by welding to the interior of the safe door 54, is a backer plate 60, which also has a crankshaft passage 62 through which the crankshaft 12 extends. The shoulder 40 of the crankshaft 12 is pulled against the backer plate 60 by a nut 44 which is attached to the threaded second end 58 of the crankshaft 12. The crankshaft 12 passes through a link arm slot 20 in the link arm 18 and through the crank plate 14, to which the crankshaft is rigidly attached. By its attachment to the crank plate 14, when the handle 38 is turned, the crankshaft 12 turns the crank plate 14, unless the crank plate 14 is in a locked position.

Referring to FIG. 1, the safe mechanism 10 is shown in an open position. In this position, the crank plate 14 has been rotated counterclockwise (when looking at the view shown in FIG. 1, which is the back view of the safe door). Descriptions of the operation of the safe mechanism will be described by reference to the view of the safe mechanism shown in FIGS. 1 and 2, that being the looking at the back side of the safe door from inside the safe. By rotating the crank plate 14 counterclockwise, the crank slider pin 16, sliding freely in the link arm slot 20, causes the link arm 18 to move to the left, or away from the doorframe 52. As the link arm 18 moves to the left of FIG. 1, the link arm slot 20 moves past the crankshaft 12, until the crankshaft 12 is in the extreme right hand side of the horizontal portion of the link arm slot. The link arm slot has a vertical portion and a horizontal portion, and in this configuration of the device, the link arm slot 20 extends through the link arm 18, and the crank slider pin 16 and the crankshaft 12 extend through the link arm slot as shown.

In order to permit the rotation of the crank plate 14, as shown in FIG. 1, the lock mechanism first has to be moved to an unlocked position, in which the lock tongue 34 is withdrawn from contact with the first crank plate notch 48. In this position, the open position lock 26 also engages with the second crank plate notch 50, and would not allow the crank plate 14 to be rotated counterclockwise until the open position throw 64 is depressed, or moved to the right of the view in FIG. 1. The open position throw 64 is depressed when the safe door 54 is closed, and the doorframe 52 of the safe door pushes against the release button 66 of the open position throw 64. In this way, the open position lock 26 prevents the locking pins 32 from being extended unless the safe door 54 is closed.

Figure 2:
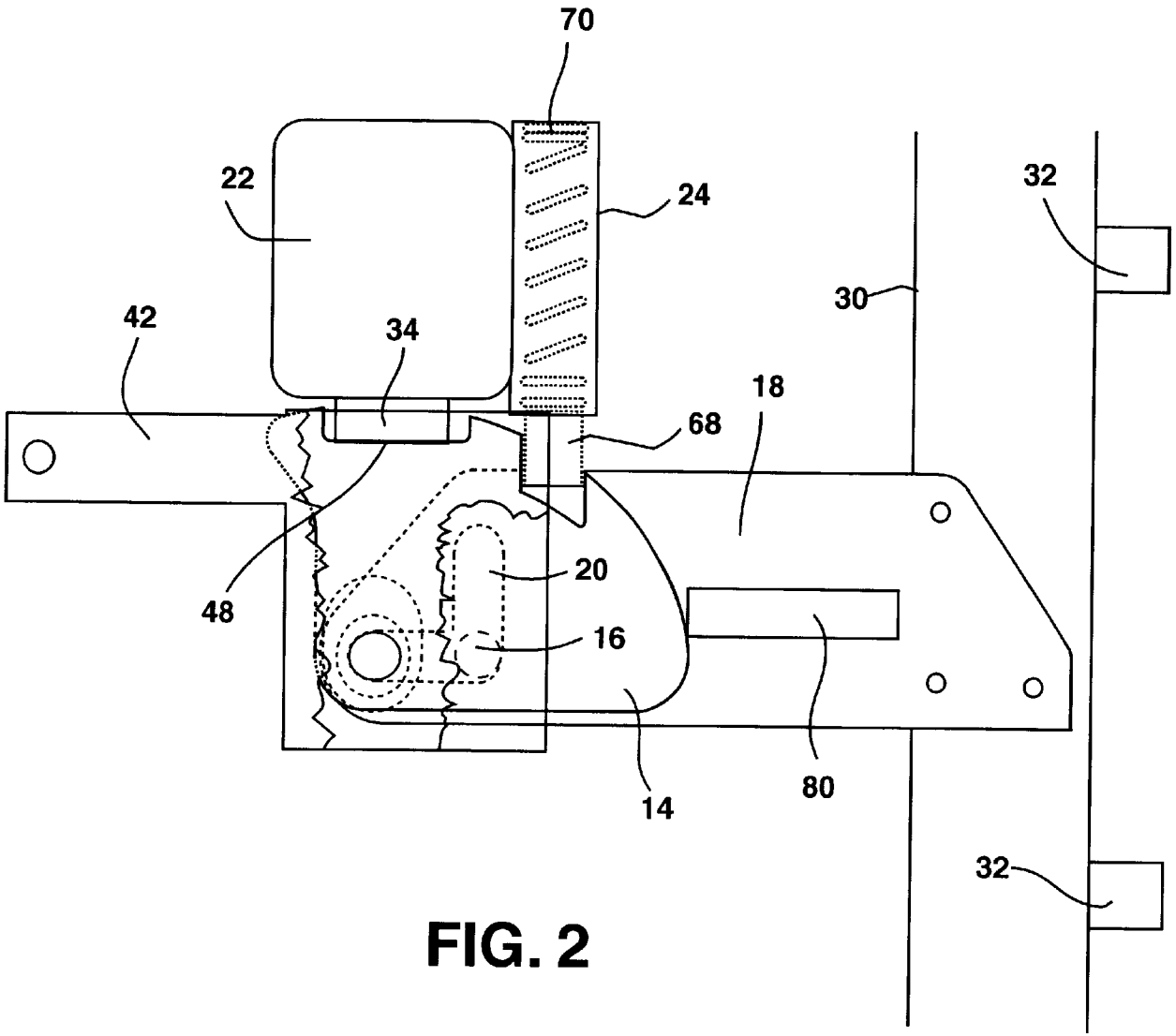
FIG. 2 is an elevational view of the lock mechanism in a closed position.

FIG. 2 shows the safe mechanism 10 in a locked position. To reach this position from that which is shown in FIG. 1, the crankshaft 12 would be rotated clockwise (from the point of view as shown in FIGS. 1 and 2), which would cause clockwise rotation of the crank plate 14. As the crank slider pin 16 of the crank plate 14 rotates clockwise, it would move in link arm slot 20, causing link arm 18 to move laterally to the right, along with the attached slider 30 and locking pins 32. In this position, first crank plate notch 48 is aligned with the tongue lock 34. In this position, if the tongue lock 34 is extended, the safe is locked and the crank plate and the link arm 18 to which it is connected would not be able to move.

Shown in FIGS. 1 and 2 is the re-locker 24. The re-locker 24 includes a re-locker tool 68, a re-locker spring 70 which is within the re-locker 24, and an arming plate 78. The re-locker tool 68 is normally held in a closed position, but when triggered, the re-locker tool 68 extends from the re-locker 24 and engages the second crank plate notch 50, thus preventing counterclockwise rotation of the crank plate 14. Shown in FIG. 2 is the partially cut away cage 42. As shown in FIG. 6, protective cage 42 confines link arm 18 to a plane parallel to the door of the safe, This prevents crank slider pin 16 from separating from the L shaped slot in link arm 18. A portion of the arming plate 78 holds the re-locker tool 68 within the re-locker 24, and partially overlaps the protective cage 42. In this way, if the cage 42 is pounded on and becomes deformed, then the re-locker tool 68 is released, and engages the second crank plate notch 50 and also the notch 76 in the link arm 18. The protective cage holds the link arm 18 and the crank plate 14 in proximity, as shown in FIG. 6. Holding these two pieces in proximity with the crank slider pin 16, which is engaged with the L-shaped slot of the link arm, the cage 42 Prevents the movement of the link arm past the crank plate without rotation of the crank plate. The lock mechanism 22 is purchased as a complete unit, and may be operated by a key, touch pad, magnetic swipe, fingerprint or other biometric identification, or as a simple combination lock as shown in FIG. 6.

Shown in FIG. 6 is an anti-drill plate 72, which is mounted so that it must be drilled through if the lock mechanism is to be drilled from outside the safe door 54.

FIG. 4 is a view which shows the crank plate 14, with the crankshaft passage 62, the first crank plate notch 48, and the second crank plate notch 50. Crank slider pin 16 protrudes from the surface of the crank plate 14, and would extend through the link arm slot 20. Although the safe mechanism could be designed in a number of sizes and configurations, and with different materials and thickness of materials, the preferred embodiment of the safe utilizes a crank plate made of three-eighth inch (⅜") steel.

FIG. 5 shows the link arm 18, with positioning bolt holes 74, and positioning bolts 28. Positioning bolts 28 would extend through these holes, and attach the link arm to the slider 30, which is then welded to prevent access by drilling out the bolts 28. The link arm of FIG. 5 also includes a link arm slot 20 and a re-locker notch 76. The re-locker notch 76 engages the re-locker tool 68, when it is extended from the re-locker 24. In this way, if the locking mechanism were defeated, and the crank plate 14 could be caused to rotate, the link arm 18 would still be locked in place if the re-locker had been activated while defeating the locking mechanism. The link arm could be of various dimensions, and made of various materials, but twelve (12) gauge steel is the preferred material for this embodiment of the claimed device. The slider 30 is also twelve (12) gauge steel, but could also be made in various sizes, materials and thickness. The locking pins 32 are made of steel, and could be a variety of sizes, such as one-half (½") inch diameter through hardened steel cylindrical posts.

Figure 3:
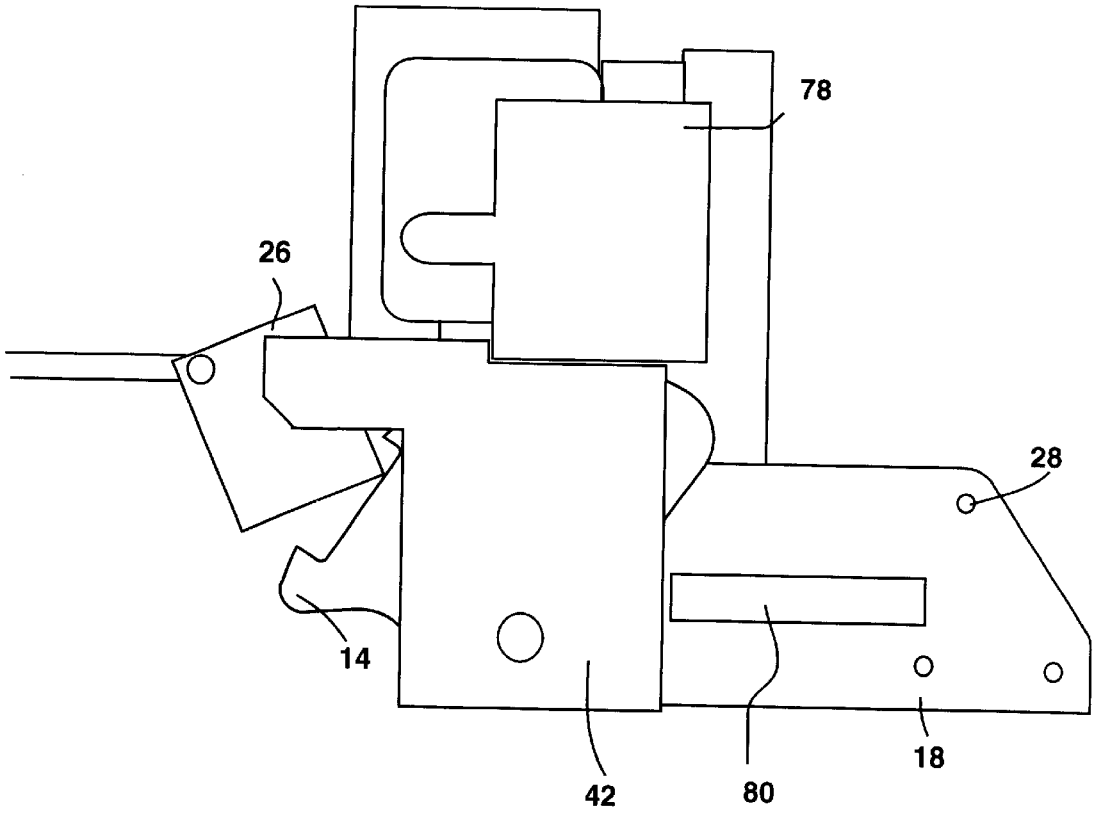
FIG. 3 is an elevational view of the lock mechanism with protective covers in place.

FIG. 3 shows an elevational view of the safe mechanism as seen from inside the safe looking at the back of the safe door 54, with the safe mechanism in an open position, and the protective cage 42 in place. This also shows the re-locker arming plate 78 in place, covering the re-locker 24 and part of the lock mechanism 22. If either the re-locker arming plate 78, or the protective cage 42 were deformed or dislodged, the re-locker 24 would extend the re-locker tool 68 and engage the link arm 18 and the crank plate 14. Shown is a stiffening bar 80, which is attached to link arm 18. If the link arm 18 is cut, the protective cage 42 holds the piece of link arm 18 with the slot in place. If the crank slider pin 16 is drilled out, and part of the link arm 18 removed, the stiffening bar 80 prevents the remnant of the link arm 18 from passing past the crank arm 14, thus preventing unauthorized retraction of the slider 30 and the locking pins 32.

The anti-drill plate 72, shown in FIG. 6, is a material which faces the front of the safe door, and makes it difficult or impossible to drill through the anti-drill plate 72 into the lock mechanism 22, without breaking drill bits. Any type of commercially available anti-drill plating can be utilized, but one which is particularly preferred is an anti-drill plating in which hard particles such as sintered tungsten carbide granules are brazed onto a steel plate with a brazing material such as nickel silver, or similar brazing material.

While there is shown and described the present preferred embodiment of the invention, it is to be distinctly understood that this invention is not limited thereto but may be variously embodied to practice within the scope of the following claims.

From the foregoing description, it will be apparent that various changes may be made without departing from the spirit and scope of the invention as defined by the following claims.

We claim:

1. A safe mechanism for use with a safe which includes a lock mechanism, a safe door, a safe door frame, and a slider with one or more attached locking pins, which comprises:

a crank shaft for opening said safe door, which penetrates said safe door and which is attached to a handle, and which includes a shoulder which when mounted to said safe door, presses against said safe door, so that an external pressure on said crank shaft is transferred to said safe door and not to said lock mechanism;

a link arm with a body and a first and a second end, in which said link arm body defines an L shaped slot, with said second end of said link arm attached to said slider with said one or more attached locking pins, for moving said slider with one or more attached locking pins into engagement with said safe door frame;

a crank assembly, which comprises said crank shaft, a crank plate attached to said crank shaft, with a crank slider pin attached to said crank plate, in which said crank slider pin engages said L shaped slot in said link arm, in which said crank assembly is engageable with said lock mechanism, and in which rotation of said crank assembly about said crank shaft moves said link arm in a first direction to an open position or in a second direction to a closed position, by movement of said crank slider pin in said L shaped slot, and wherein in said closed position lateral motion of said link arm in a first direction without simultaneous turning of said crank assembly in a first direction is blocked by said crank slider pin in said L shaped slot.

2. The safe mechanism of claim 1 in which said L shaped slot comprises a horizontal portion, and a vertical portion, with said horizontal portion joined to said vertical portion at a generally ninety degree angle, and in which said crank slider pin and said crank shaft extends into said L shaped slot.

3. The safe mechanism of claim 1 in which said L shaped slot extends through said link arm, and said crank slider pin and said crank shaft extends through said L shaped slot.

4. The safe mechanism of claim 1 in which said crank plate comprises a first notch which is engageable with a tongue of said lock mechanism in a locked position and when said tongue of said lock mechanism is in an extended position.

5. The safe mechanism of claim 4 in which said crank plate further comprises a second notch and a re-locker, in which said re-locker is engageable simultaneously with said link arm and said second notch.

6. The safe mechanism of claim 1, which further comprises a backing piece attached to an inside surface of said safe door, with said backing piece and said safe door defining a crank passage, and with said crank passage in said backing piece sized smaller than said crank shaft shoulder, and with said shoulder of said crank shaft mounted adjacent to said backing piece in said crank passage in said safe door.

7. The safe mechanism of claim 1 in which said shoulder of said crank shaft is at least partially recessed in said crank passage in said safe door.

8. The safe mechanism of claim 1 which further includes a protective cage which provides support for said crank plate and said link arm, and which prevents movement of said link arm past said crank plate without rotation of said crank plate.

9. The safe mechanism of claim 8 in which said protective cage is configured to serve as a release means for activation of said re-locker, wherein deflection of said protective cage activates said re-locker.

10. The safe mechanism of claim 1 in which said link arm includes a stiffener bar attached to said link arm body, and a protective cage, in which said protective cage provides support for said link arm and said crank plate, and in which said protective cage and said stiffener bar work together to prevent passage of said link arm past said crank plate without rotation of said crank plate, by said stiffener bar pressing against said crank plate when said link arm is moved in a second direction to an open position, causing said crank plate to jam against said protective cage.

11. A safe mechanism for use with a safe which includes a lock mechanism, a safe door, a safe door frame and a slider with one or more attached locking pins, which comprises:

a crank shaft for opening said safe door, which penetrates said safe door and which is attached to a handle, and which includes a shoulder which when mounted to said safe door, presses against said safe door, so that an external pressure on said crank shaft is transferred to said safe door;

a link arm with a body and a first and a second end, in which said link arm body defines a slot, with said second end of said link arm attached to said slider with one or more attached locking pins, for moving said slider with one or more attached locking pins into engagement with said safe door frame;

a crank assembly, which comprises said crank shaft, a crank plate attached to said crank shaft, with a crank slider pin attached to said crank plate, in which said crank slider pin engages said slot in said link arm, in which said crank assembly is engageable with said lock mechanism, and in which rotation of said crank assembly about said crank shaft moves said link arm in a first direction or a second direction, by movement of said crank slider pin in said slot, and in which said crank plate comprises a first notch which is engageable with a tongue of said lock mechanism in a locked position and when said tongue of said lock mechanism is in an extended position, and in which said crank plate further comprises a second notch which is engageable with a re-locker; and an open position lock which engages said second notch, and which prevents said one or more attached locking pins attached to said slider from extending while said safe door is in an open position.

12. A safe mechanism for use with a safe which includes a lock mechanism, a safe door, a link arm, one or more attached locking pins on a slider, and a crank plate, which comprises:

a re-locker mechanism which acts as a secondary lock to said lock mechanism, which is activated by one or more release means, which when activated extends a relocking tool for engagement with both said crank plate and said link arm.

13. The safe mechanism of claim 12, in which said relocking tool is a generally rectangular bar which is extendible for engagement with said crank plate and said link arm.

14. The safe mechanism of claim 12 in which said relocking tool engages a corresponding notch in said crank plate and said link arm.

15. The safe mechanism of claim 12 in which said release means for activation of said re-locker mechanism is deflection of said lock mechanism from an operational position.

16. The safe mechanism of claim 12 in which said release means for activation of said re-locker mechanism is deflection of a lock tongue of said lock mechanism from an engage position.

17. A safe mechanism for use with a safe which includes a lock mechanism, a safe door, a safe door frame, and a slider with one or more attached locking pins, which comprises:

a link arm with a body and a first and a second end, in which said link arm body defines an L shaped slot, with said L shaped slot comprised of a horizontal portion, and a vertical portion, with said horizontal portion joined to said vertical portion at a generally ninety degree angle, and with said second end of said link arm attached to said slider with said one or more attached locking pins, for moving said slider with said one or more attached locking pins into and out of engagement with said safe door frame;

a crank assembly, which comprises a crank shaft, a crank shoulder, a crank plate attached to said crank shaft, with a crank slider pin attached to said crank plate, in which said crank slider pin engages said L shaped slot in said link arm, in which said crank assembly is engageable with said lock mechanism, in which said crank shaft and crank slider pin extend into said horizontal portion of said L shaped slot and in which rotation of said crank assembly about said crank shaft moves said link arm in a first direction or a second direction, by movement of said crank slider pin and said crank shaft in said L shaped slot, and in which said crank shoulder is configured to transfer external pressure such as from pounding, to said safe door and not to other safe components, and in which rotation of said crank assembly about said crank shaft moves said link arm in a first direction to an open position or in a second direction to a closed position, by movement of said crank slider pin and said crank shaft in said L shaped slot, and wherein in said closed position lateral motion of said link arm in a first direction without simultaneous turning of said crank assembly in a first direction is blocked by said crank slider pin in said L shaped slot.

* * * * *